United States Patent [19]

Carpenter et al.

[11] 4,164,104

[45] Aug. 14, 1979

[54] APPARATUS AND METHOD FOR OBTAINING A SHORTENED BLAST PATTERN WITH A CENTRIFUGAL THROWING WHEEL

[75] Inventors: James H. Carpenter; Donald G. Corderman, both of Hagerstown, Md.

[73] Assignee: The Carborundum Company, Niagara Falls, N.Y.

[21] Appl. No.: 846,302

[22] Filed: Oct. 28, 1977

[51] Int. Cl.[2] ..... B24C 5/06

[52] U.S. Cl. ..... 51/432; 51/434

[58] Field of Search ..... 51/432, 433, 434

[56] References Cited

U.S. PATENT DOCUMENTS

| | | | |
|---|---|---|---|
| 2,162,139 | 6/1939 | Unger | 51/432 |
| 2,590,576 | 3/1952 | Rosenberger | 51/434 |
| 3,290,827 | 12/1966 | Bowling | 51/434 |

*Primary Examiner*—Gary L. Smith

*Attorney, Agent, or Firm*—David E. Dougherty; William H. Holt

[57] ABSTRACT

Apparatus and method are provided for producing a blast pattern with a centrifugal throwing wheel for alternatively providing a blast pattern having a conventional length and for providing a blast pattern having a shorter length than heretofore possible with a standard throwing wheel.

4 Claims, 14 Drawing Figures

APPARATUS AND METHOD FOR OBTAINING A SHORTENED BLAST PATTERN WITH A CENTRIFUGAL THROWING WHEEL

SUMMARY OF THE INVENTION

The invention relates to the art of centrifugal throwing wheels and more particularly to apparatus and method for creating a blast pattern having a shorter length than heretofore possible with a conventional throwing wheel.

The invention comprises an impeller for a centrifugal throwing wheel of the type having throwing vanes mounted on a rotatable runnerhead, the impeller having impeller vanes for causing blast media to be deposited on the throwing vanes during rotation of the runnerhead for causing the blast media to be thrown from the throwing vanes in a blast pattern, the impeller also having attachment means for attaching the impeller to the runnerhead, the improvement characterized by the attachment means comprising means for attaching the impeller to the runnerhead in a pre-selected one of a plurality of positions for selectively varying the shape of the blast pattern.

The invention further comprises an impeller for a throwing wheel wherein the impeller includes a series of impeller vanes spaced by a series of windows which allow blast media to pass outwardly thereof, a hub at one end of the impeller for attaching the impeller to a runnerhead, and index means carried by the hub, the index means comprising a pair of spaced key means for selectively locating the impeller on a runnerhead.

The invention further comprises a method of depositing blast media on throwing vanes of a centrifugal throwing wheel, the method including the steps of locating a package of blast media in front of one throwing vane, rotating the one throwing vane in a manner to capture a first portion of the package of blast media, and depositing the remaining portion of the package of blast media on a following throwing vane.

An important object of the invention is to provide novel apparatus and method for producing a tight, or shortened, blast pattern which can be obtained by a simple adjustment in the position of a standard impeller in relation to respective throwing vanes in a centrifugal wheel.

A further object of the invention is to provide novel apparatus and method for depositing blast media upon a throwing vane in such a manner that the wear life of the throwing vane is increased.

BACKGROUND OF THE INVENTION

In the art of centrifugal throwing wheels, it is well-known how to lengthen the blast stream pattern. Conventional throwing wheels include a series of throwing vanes fixedly secured to a rotatable runnerhead, an impeller fixedly secured centrally of the runnerhead, and an impeller case which circumscribes the impeller and is provided with an opening through which the impeller causes blast media to be moved into locations such that the blast media is picked up by a respective throwing vane adjacent a heel portion thereof and accelerated as the blast media slides outwardly along the throwing vane toward the tip thereof. It is well-known that the tightest, or shortest pattern is achieved if the opening in the impeller case is a rectangular slot; changing the shape of the opening to a modified, or triangular slot spreads the pattern. The reason for this is that the triangular or similar slot causes the particulate, blast media to be deposited on the heel of the throwing vane over a longer period of time and this results in the blast media coming off of the tip of the vane also over a longer period of time and therefor produces a longer pattern.

There are times when it is desirable to shorten the pattern that results from using a conventional rectangular slot. If the particulate blast media is put on the heel of the throwing vane in a smaller or tighter package, it will also discharge over a shorter arc of rotation and result in a tighter or shorter pattern. Various methods have been tried in order to shorten the deposited package. For example, using more throwing vanes than the conventional eight vanes will result in a smaller package being placed on each vane. Also, reducing the circumferential dimension of the rectangular opening has been tried and it is thought to shorten the pattern in some instances; however, reduction of the rectangular opening necessarily limits the amount of blast media that can pass therethrough.

U.S. Pat. No. 3,290,827, granted on Dec. 13, 1966 discloses a throwing wheel which exemplifies the prior art to which the present invention particularly relates.

DETAILED DESCRIPTION OF THE INVENTION

Figure 2:
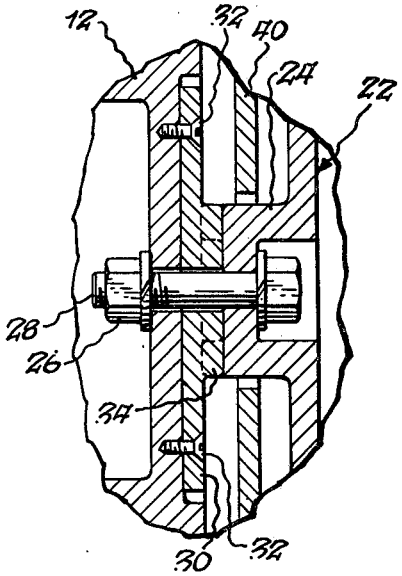
FIG. 2 is an enlarged, fragmentary section taken on line 2—2 of FIG. 1.

A portion of a throwing wheel, generally indicated by the numeral 10, includes a runnerhead 12 which is provided with a series of throwing vanes 14, 15, 16, 17, 18, 19, 20, and 21. An impeller 22, the construction of which is more particularly shown in FIGS. 11 and 12, includes a hub portion 24 which is fixedly secured to the runnerhead 12 by a nut 26 and a bolt 28 in a manner best shown in FIG. 2. An inner runnerhead 30 is secured to the runnerhead 12 by a plurality of screws 32 and carries an elongated key or rib 34 which is selectively fitted into one of a pair of slots or keyways 36 or 38 (see FIGS. 11 and 12) for precluding relative rotation between the impeller 22, inner runnerhead 30 and runnerhead 12. The key or rib 34 and the slots or keyways 36 and 38 provide index means for selectively positioning the impeller 22 on the runnerhead 12 to provide either a short blast pattern (S) or a long blast pattern (L) dependent upon whether the key or rib 34 is cooperating with slot 38 or slot 36.

Throwing wheel 10 also includes a conventional impeller case 40 which surrounds the impeller 22 and includes an opening 42 through which blast media, such as abrasive particles, or abrasive grit, or peening balls, and the like are thrown by the impeller in front of the respective throwing vanes 14, 15, etc. It is well-known to those skilled in the art that during operation of the throwing wheel 10, the throwing vanes and impeller 22 rotate relative to the impeller case 40; for further details of the operation of a throwing wheel attention is directed to the aforementioned U.S. Pat. No. 3,290,827.

Figure 6:
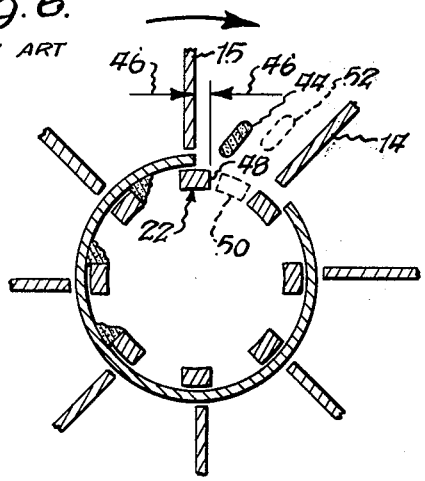
Fig. 6. PRIOR ART
FIGS. 6, 7, and 8 are fragmentary views of a throwing wheel constructed and arranged in accordance with prior art.
Figure 7:
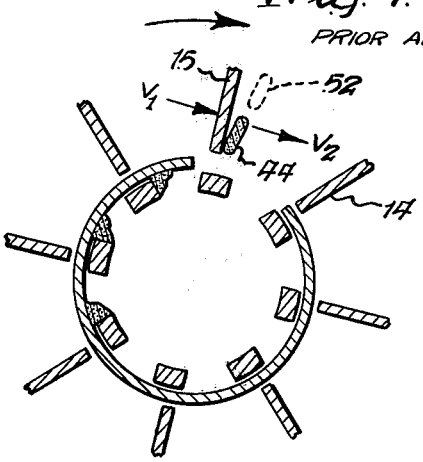
Fig. 7. PRIOR ART
Figure 8:
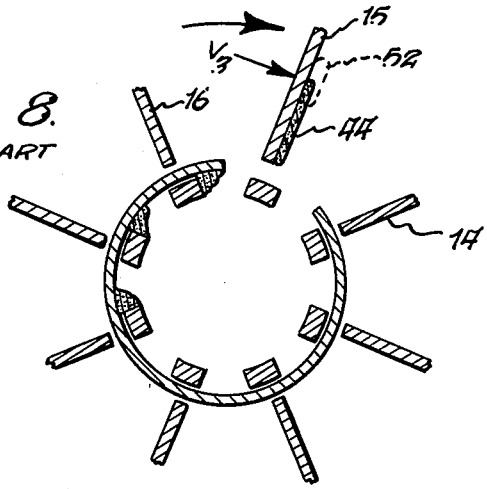
Fig. 8. PRIOR ART
Figure 9:
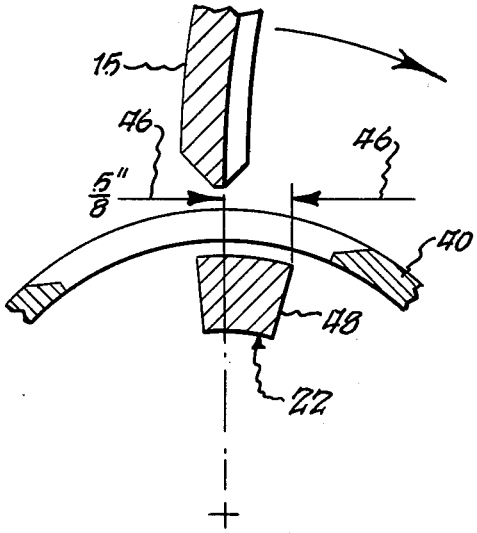
Fig. 9. PRIOR ART
FIG. 9 is a fragmentary view, partly in section, illustrating a prior art throwing wheel wherein the impeller vane is located in a position which leads its respective throwing vane by a "standard lead" of approximately $\frac{5}{8}$ inch.

The present invention will be best understood following an explanation of the prior art and for this purpose, attention is directed to FIGS. 6–9, inclusive, wherein like numerals are used to indicate the respective parts. An important factor in controlling the blast pattern and minimizing wear on the throwing vane is where on the heel of the throwing vane the abrasive package is deposited by the impeller. FIGS. 6, 7, and 8 show the manner in which a package of blast media 44 is deposited very close to the heel of the throwing vanes. This is important for two reasons. Referring to FIG. 7, the closer the velocity $V_1$ of the throwing vane 15 and the velocity $V_2$ of the abrasive package 44 are to each other the more gentle will be the impact of the package of blast media 44 on the throwing vane 15. A gentle impact results in less wear on the throwing vane and also less disturbance of the package of blast media 44. In order to deposit the package of blast media 44 on the heel of the throwing vane 15, the lead dimension, indicated by the arrows 46, is important. This lead dimension is the distance that the impeller vane face 48, of the impeller 22, is leading the respective throwing vane 15. Testing and high speed photography has shown that this lead dimension 46 should be approximately $\frac{5}{8}$ inch (see FIG. 9) in order to place the package of blast media 44 at the heel of the throwing vane 15. It can be seen in FIG. 6 that if the lead dimension were advanced so that the impeller vane 22 was located at the dotted line position 50 the resulting abrasive package 52 would be picked up by the throwing vane 15 at a point outwardly from the vane heel (see FIG. 8) and at this point the velocity $V_3$ of the throwing vane 15 would be much higher than the velocity of the abrasive package 52 thus resulting in greater wear of the throwing vane 15 and greater disturbance of the abrasive package 52.

Figure 10:
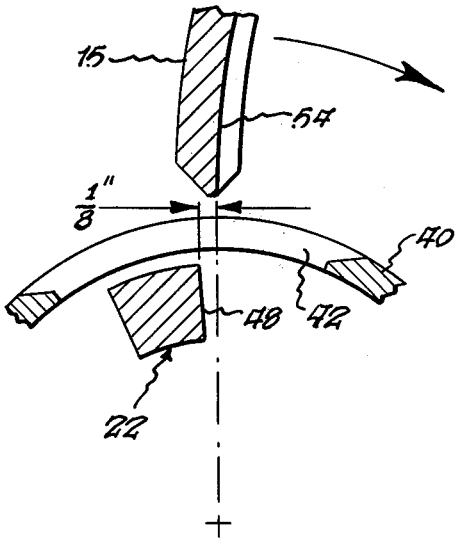
FIG. 10 is a fragmentary view of the present invention and illustrates the impeller vane as lagging its respective throwing vane by a distance of approximately $\frac{1}{8}$ inch.

As previously pointed out, an object of the present invention is to devise a way to shorten an abrasive blast pattern without any detrimental effects on the wear-life of the throwing vanes. Laboratory testing has revealed a novel way to shorten the shortest blast pattern now possible through a conventional rectangular slot in an impeller case. Through a process of measurement of various blast patterns, it has been determined that if the impeller vane is set to lag the throwing vane, rather than lead the throwing vane as in the prior art, a tighter abrasive pattern resulted. As is shown in FIG. 10, it is preferred that the impeller vane face 48 lags the face 54 of the throwing vane 15 by a dimension approximating $\frac{1}{8}$ inch. The unique and unexpected result achieved by having the impeller lag the throwing vane, rather than leading the throwing vane, will be best understood by referring to the showings in FIGS. 1–5, inclusive.

Figure 1:
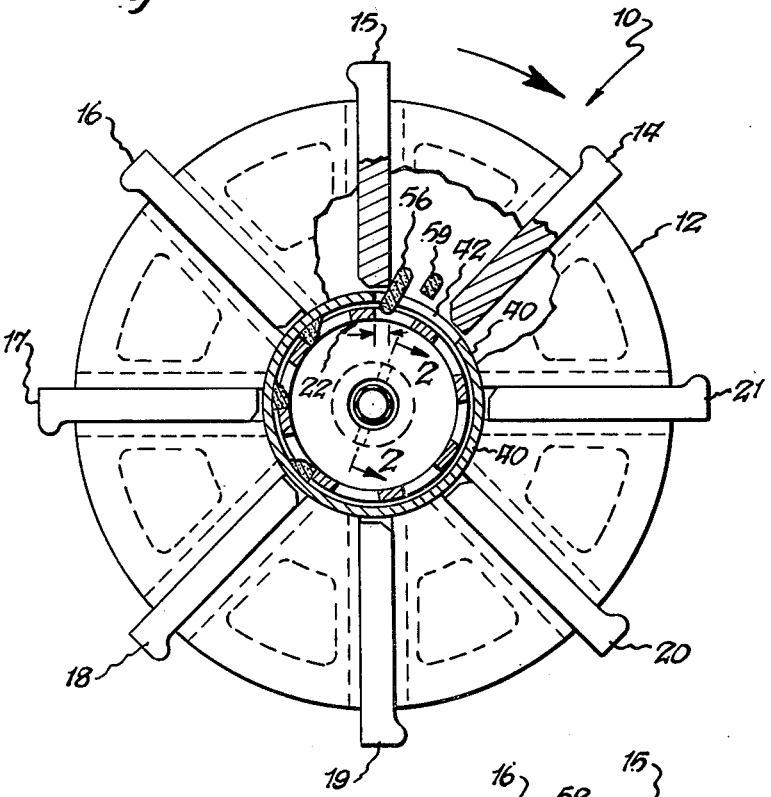
FIG. 1 is a fragmentary, elevational view, partly in section, which illustrates the present invention.
Figure 3:
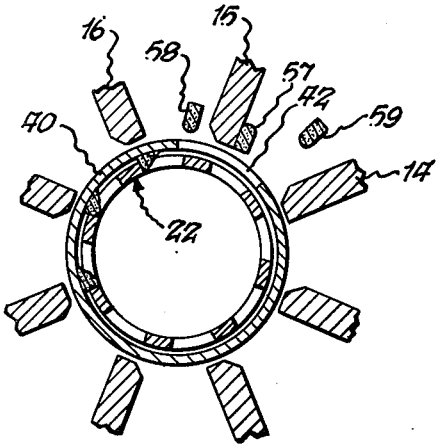
FIG. 3 is a fragmentary view, similar to FIG. 1, and illustrates the manner in which the throwing vane divides the package of blast media.
Figure 4:
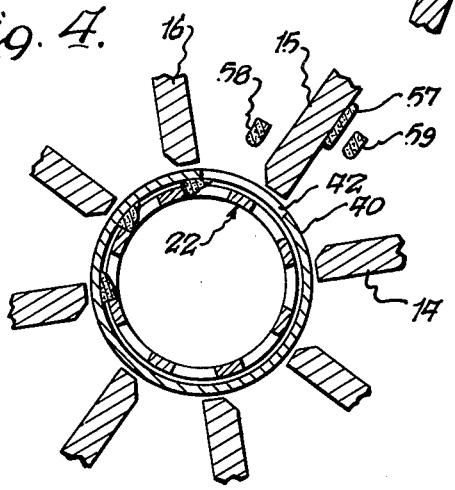
FIG. 4 is a fragmentary view, similar to FIG. 3, and illustrates the location of the separate pieces of the package of blast media at a time shortly after the showing in FIG. 3.
Figure 5:
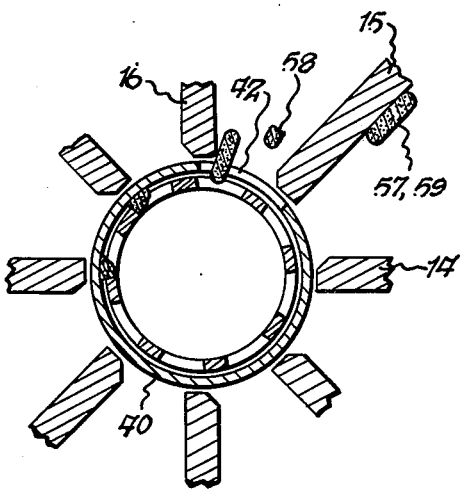
FIG. 5 is a fragmentary view, similar to FIGS. 3 and 4, and illustrates the manner in which separated portions of the package of blast media are combined together on a single throwing vane.

As is shown in FIG. 1, a package of blast media 56 which is understood to contain a considerable number of particles of abrasive grit or the like, is moved by the impeller 22 through the opening 42 in the impeller case 40 such that the package 56 is contacted by the rotating throwing vane 15. Instead of the package 56 being deposited completely on the heel of the throwing vane (such as in FIGS. 6–8) the throwing vane 15 splits the package 56 into approximately equal portions 57 and 58 (see FIG. 3) such that only the portion 57 is picked up by the heel of the throwing vane 15. The approximate other half portion 58 will be picked up by the following throwing vane 16. In FIGS. 1, 3 and 4, a portion 59 is the same as portion 58 except that portion 59 has been formed by the preceding throwing vane 14. Note that as the portion 57 advances out along throwing vane 15 that the approximately half portion 59 is deposited on top of the portion 57 thus resulting in the two approximately half portions 57 and 59 being combined together as will be understood by considering FIGS. 4 and 5. Combining the portions 57 and 59 into a small package to be discharged from the throwing vane 15 over a smaller arc of rotation therefore produces a shorter blast pattern than can be achieved by the prior art exemplified by the showings in FIGS. 6–9, inclusive. This result has been verified by laboratory data which indicates that 42.56% of the abrasive particles are deposited in the central four segments of conventional test equipment whereas only 31.15% of the particles were deposited in the central four segments by using prior art throwing wheels. It can also be seen from the foregoing explanation that the problem of wear resulting from picking up the abrasive package far out on the throwing vane is substantially minimized because the portion 57 cushions the portion 59; here again, laboratory tests have shown that the resultant wear of the throwing vane is less with the present invention than in the prior art.

Figure 11:
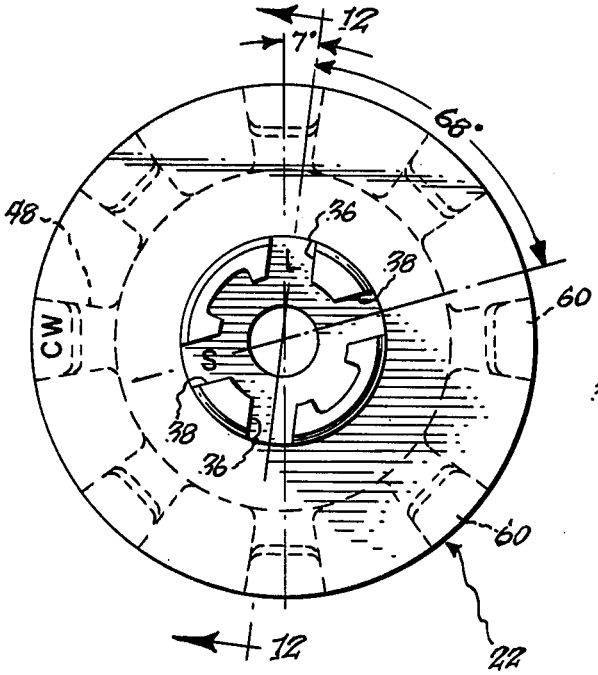
FIG. 11 is an end view of an impeller constructed in accordance with the invention for use with a throwing wheel intended to rotate in a clockwise (CW) direction.
Figure 12:
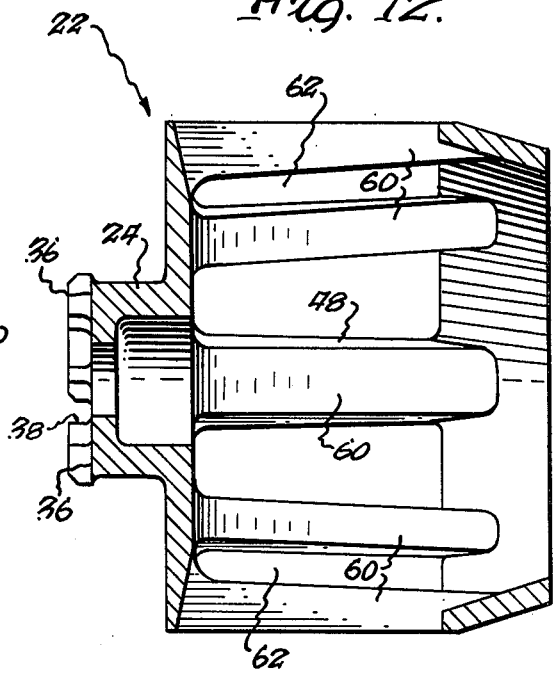
FIG. 12 is a sectional view of an impeller, taken on line 12—12 of FIG. 11.
Figure 13:
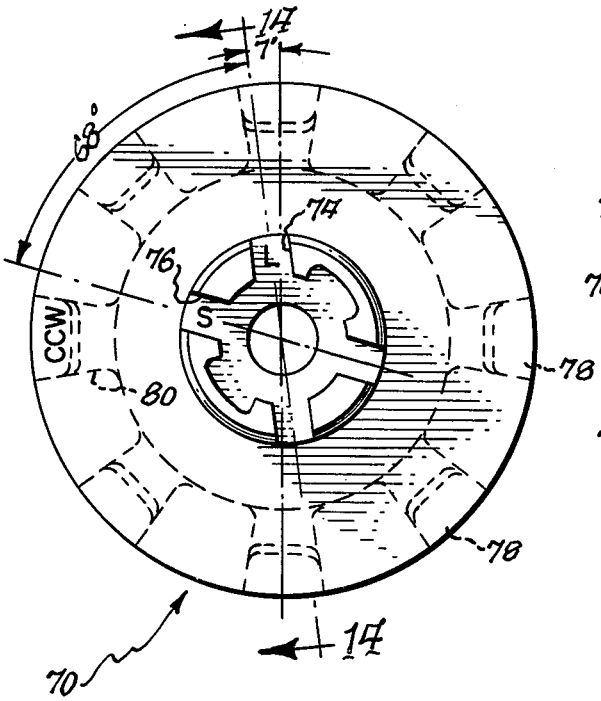
FIG. 13 is an end view of an impeller constructed in accordance with the present invention for use in a throwing wheel which is intended to be rotated in a counterclockwise (CCW) direction.
Figure 14:
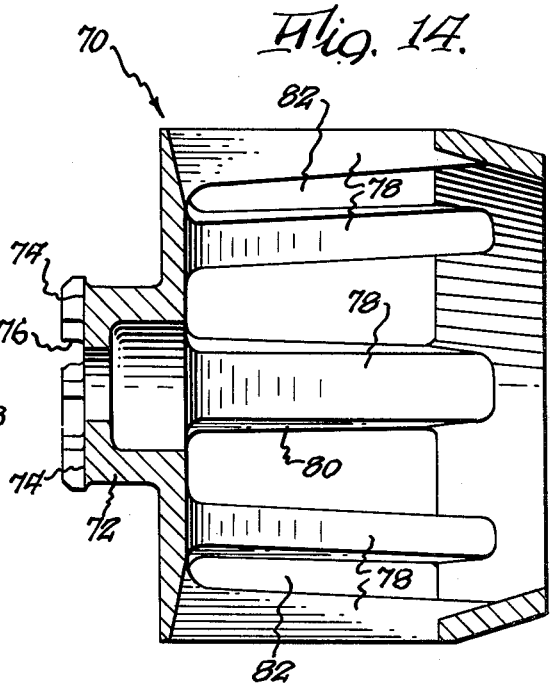
FIG. 14 is a sectional view of an impeller, taken on line 14—14 of FIG. 13.

FIGS. 11 and 12 illustrate the constructional details of the impeller 22 which is intended to be used with a throwing wheel which rotates in a clockwise direction (as marked by the letters CW). The slot or keyway 36 is intended to cooperate with the key or rib 34 (FIG. 2) to provide a long blast pattern and the slot 36 is marked with the letter (L). Similarly, the slot or keyway 38 is intended to cooperate with the key or rib 34 to provide a short blast pattern, and the slot 38 is marked with the letter (S). The impellar 22 includes a series of impeller vanes 60 each of which are spaced to provide a series of windows 62 and each impeller vane 60 is provided with a vane face 48 which causes the abrasive package, such as package 56, to be moved outwardly through the opening 42 in the impellar case 40 (see FIG. 1, etc.). FIGS. 13 and 14 illustrate a modified form of impeller 70 which is intended to be used with throwing wheels which rotate in a counterclockwise direction and the impeller 70 is marked with the letters (CCW). The impeller 70 is provided with a hub portion 72 which includes a pair of slots or keyways 74 and 76 respectively marked with the letters (L) and (S) to indicate the slot or keyway to be used for providing a long blast pattern or a short blast pattern. In other respects, the impeller 70 is similar to the impeller 22 and is provided with a series of spaced impeller vanes 78 each having an impeller vane face 80 which are spaced to provide a series of windows 82.

FIG. 11 illustrates that the slots or keyways 36 and 38 are disposed relative to each other so as to form an included angle therebetween of 68 degrees. Similarly, FIG. 13 illustrates that the slots or keyways 74 and 76 are disposed to form an included angle therebetween which also equals 68 degrees.

The foregoing detailed description of the preferred embodiments of the invention both as to the apparatus for and the method of splitting the package of blast media, are susceptible to various modifications which will be obvious to those skilled in the art; accordingly, it is to be understood that various changes and modifications may be made within the spirit and scope of the invention as defined by the following claimed subject matter.

We claim:

1. In a centrifugal throwing wheel, the combination of a rotatable runnerhead, a plurality of throwing vanes carried by said runnerhead, and an impeller having impeller vanes for causing blast media to be deposited on said throwing vanes during rotation of said runnerhead for causing said blast media to be thrown from said throwing vanes in a blast pattern, said impeller also having attachment means for attaching said impeller to said runnerhead, the improvement characterized by said attachment means comprising means for attaching said impeller to said runnerhead in a preselected one of a plurality of positions for selectively varying the shape of said blast pattern, said attachment means including index means for locating said impeller vanes in a lagging position relative to the throwing vanes.

2. An impeller as defined in claim 1 wherein said attachment means includes a hub forming part of said impeller, said means for attaching said impeller to said runnerhead comprising said hub including key means for selectively cooperating with complementary key means carried by said runnerhead.

3. An impeller as defined in claim 2 wherein the key means included in said hub comprises a plurality of key slots formed in said hub.

4. An impeller for a throwing wheel, said impeller including a series of impeller vanes spaced by a series of windows which allow blast media to pass outwardly thereof, a hub at one end of said impeller for attaching said impeller to a runnerhead, and index means carried by said hub, said index means comprising a pair of spaced key means for selectively locating said impeller on a runnerhead, said key means being comprised of a pair of slots extending across an end face of said hub, said pair of slots forming an included angle of approximately 68 degrees.

* * * * *